United States Patent [19]

Ebinger et al.

[11] 4,432,892

[45] Feb. 21, 1984

[54] PROCESS FOR THE SAFE INTERMEDIATE AND FINAL STORAGE OF TRITIUM

[75] Inventors: Horst Ebinger, Bad Soden-Salmuenster; Martin Kadner, Maintal; Guenther Luthardt, Rodenbach, all of Fed. Rep. of Germany

[73] Assignee: Nukem GmbH, Hanau, Fed. Rep. of Germany

[21] Appl. No.: 263,346

[22] Filed: May 13, 1981

[30] Foreign Application Priority Data

May 16, 1980 [DE] Fed. Rep. of Germany ..... 3018745

[51] Int. Cl.[3] ..... G21F 9/02; G21F 9/16

[52] U.S. Cl. ..... 252/628; 252/630; 423/648 R; 423/648 A

[58] Field of Search ..... 252/628, 630; 423/648 R, 648 A

[56] References Cited

U.S. PATENT DOCUMENTS

| | | | |
|---|---|---|---|
| 4,133,426 | 1/1979 | Turillon et al. | 423/648 R |
| 4,134,490 | 1/1979 | Turillon et al. | 423/648 R |

FOREIGN PATENT DOCUMENTS

| | | | |
|---|---|---|---|
| 2756700 | 6/1978 | Fed. Rep. of Germany . | |
| 2818781 | 11/1978 | Fed. Rep. of Germany . | |
| 2819086 | 10/1979 | Fed. Rep. of Germany . | |
| 2824475 | 4/1980 | Fed. Rep. of Germany . | |
| 2353117 | 12/1977 | France . | |
| 54-4025295 | 2/1979 | Japan | 423/648 A |
| 2032165 | 4/1980 | United Kingdom | 252/628 |

*Primary Examiner*—Brooks H. Hunt

*Attorney, Agent, or Firm*—Cushman, Darby & Cushman

[57] ABSTRACT

For the safe intermediate and final storage of tritium after reaction with a hydride forming metal, it is embedded in concrete which, of course, does not lead to a complete exclusion from the environment since the tritium is able to permeate through the concrete. This is avoided by pressing to molded bodies at room temperature the tritium containing metal particles with powders of metals which have a low permeability for tritium.

16 Claims, No Drawings

PROCESS FOR THE SAFE INTERMEDIATE AND FINAL STORAGE OF TRITIUM

BACKGROUND OF THE INVENTION

The invention is directed to a process for the safe intermediate and final storage of tritium after reaction of tritium or tritium containing gases with hydride forming metals in comminuted form with formation of metal tritides.

Tritium containing residues and waste which accumulate in many areas of the nuclear art must be stored safely and without contact with the biosphere in order to avoid danger to the environment. Thus, for example, tritium containing water can be treated with hydraulic binders (Portland cement, Sorel cement) and admixtures which improve the binding of the tritiated water (German OS No. 2819086 and German OS No. 2842475). However, with this binding, there is not obtained sufficient resistance to leaching out the tritium.

Furthermore, it is known to react tritium or tritium containing gases with hydride forming metal powders or metal granulates with formation of metal tritides. A later tying up of this metal tritide or other tritium containing metal waste in concrete certainly does not guarantee the complete exclusion from the environment since the tritium is able to permeate through the concrete.

Therefore, it was the task of the present invention to develop a process for the safe intermediate and final storage of tritium after reaction of the tritium or tritium containing gases with hydride forming metals in comminuted form, which guarantees a safe enclosing of the tritium and in a given case guarantees a reprocessing.

SUMMARY OF THE INVENTION

This problem was solved according to the invention by pressing into a molded body at room temperature the tritium containing metal particles with a powder of a metal with low tritium permeability.

Preferably, for this purpose there is used aluminum powder; but there can also be used other metal powders with low tritium permeabilities as, for example, stainless steel, copper, or molybdenum.

It has proven particularly effective to carry out the pressing process in a jacket made of a metal with low tritium permeability, especially an aluminum jacket.

The tritium containing gas is bound to a suitable hydride former such as titanium, zirconium, rare earths, or depleted uranium, preferably in the form of pieces. Illustrative rare earths are cerium, neodymium, dysprosium, praseodymium, and samarium. The metal hydride or tritide, respectively, powder formed is then mixed with a powder of a metal which is impervious to tritium or has at least a low tritium permeability and worked according to powder metallurgy pressing processes to molded bodies in which the tritium is tightly embedded on all sides.

In order to still further reduce a theoretically possible release of tritium, and thus produced molded body is advantageously inserted into a metal containment, preferably made of steel. For this purpose, there have proven good tubes or U-profiles which are closed after filling with the molded bodies and preferably are further compacted by cold forming, as by rolls or presses. These products can be intermediately stored or also inserted into a final storage drum and subsequently cast with concrete.

The especial advantage of the process of the invention is the formation of a multiple barrier system which minimizes the release of tritium. Besides, the containment prevents a reciprocal action between the aluminum matrix and the concrete filling.

The process can comprise, consist essentially of, or consist of the steps set forth with the stated materials.

The following example explains in more detail the advantages of the process of the invention.

DETAILED DESCRIPTION

Example

A tritium containing body made of titanium was surrounded on all sides with aluminum powder in the pressing mold. The mold was clad beforehand with an aluminum jacket. Thereupon, the slug was compressed with a force of 6 Mp/cm$^2$; subsequently, the aluminum jacket was tightly sealed in a further processing step.

This type of enclosed titanium body compared to a piece of substantially the same type but not enclosed emitted only a negligibly small amount of tritium. By including the slug in a stainless steel tube closed on one side which was closed after the filling, the emission could not be measured (because it was so small).

The entire disclosure of German priority application No. P 3018745.2 is hereby incorporated by reference.

We claim:

1. In a process for the safe intermediate and final storage of tritium after reaction of tritium or a tritium containing gas with a hydride forming metal in comminuted form, the improvement comprising pressing to a molded body at room temperature a mirton of the tritium containing metal particles and a metal which has a low permeability for tritium.

2. A process according to claim 1 wherein for the pressing there is used aluminum powder.

3. A process according to claim 2 wherein the pressing process is carried out in a jacket of a metal which has a low permeability for tritium.

4. A process according to claim 1 wherein the pressing process is carried out in a jacket of a metal which has a low permeability for tritium.

5. A process according to claim 4 wherein the molded body is inserted in a metal containment.

6. A process according to claim 3 wherein the molded body is inserted in a metal containment.

7. A process according to claim 2 wherein the molded body is inserted in a metal containment.

8. A process according to claim 1 wherein the molded body is inserted in a metal containment.

9. A process according to claim 5 wherein the containment is in the form of a tube or U-profile.

10. A process according to claim 5 wherein the containment is made of steel.

11. A process according to claim 5, including the steps of filling the containment with molded bodies, then closing the containment and rolling or pressing the containment flat.

12. A process according to claim 11 comprising inserting the shaped containment in a final storage container and casting it in concrete.

13. A process according to claim 8 comprising inserting the shaped containment in a final storage container and casting it in concrete.

14. A process according to claim 7 comprising inserting the shaped containment in a final storage container and casting it in concrete.

15. A process according to claim 6 comprising inserting the shaped containment in a final storage container and casting it in concrete.

16. A process according to claim 5 comprising inserting the shaped containment in a final storage container and casting it in concrete.

* * * * *